United States Patent [19]

Olson

[11] Patent Number: 4,733,789

[45] Date of Patent: Mar. 29, 1988

[54] SHIPPING CONTAINER

[76] Inventor: Gerald W. Olson, Rt. 1, Box 845 S-6, Rosharon, Tex. 77583

[21] Appl. No.: 922,678

[22] Filed: Oct. 24, 1986

[51] Int. Cl.[4] ..... B65D 8/14; B65D 85/20

[52] U.S. Cl. ..... 220/8; 206/379; 206/446

[58] Field of Search ..... 220/8; 206/379, 446

[56] References Cited

U.S. PATENT DOCUMENTS

| | | | |
|---|---|---|---|
| 504,445 | 9/1893 | Dare | 220/8 |
| 2,266,001 | 12/1941 | Christanson | 220/8 |
| 2,641,396 | 6/1953 | Parr | 220/8 |
| 3,179,278 | 4/1965 | Cohen | 220/8 |
| 3,198,321 | 8/1965 | Politano | 220/8 |
| 4,046,279 | 9/1977 | Posler | 220/8 |

FOREIGN PATENT DOCUMENTS

| | | | |
|---|---|---|---|
| 578769 | 4/1932 | Fed. Rep. of Germany | 220/8 |
| Ad38623 | 6/1931 | France | 220/8 |
| 1497929 | 1/1978 | United Kingdom | 220/446 |
| 861184 | 9/1981 | U.S.S.R. | 220/8 |

*Primary Examiner*—George E. Lowrance

*Attorney, Agent, or Firm*—Gun, Lee & Jackson

[57] ABSTRACT

A universal shipping container comprises two separable and telescoping components. The shipping container includes a base plate supporting an upstanding tubular body to be received within a tubular body extending downwardly from a top ring plate. The ring plate includes a central opening for receiving the shanks of a drill bit therethrough. The telescoping components include cooperating fasteners for securely holding the drill bit within the shipping container.

12 Claims, 7 Drawing Figures

SHIPPING CONTAINER

BACKGROUND OF THE DISCLOSURE

The present invention is directed to a shipping container, particularly, a universal shipping container for transporting drill bits for use in the oil drilling industry.

When preparing a well plan for drilling an oil well, hole sizes, casing depths, and formations to be drilled are analyzed and the types of drill bits suited for the digging that will be required are selected and delivered to the well site. Bit suppliers maintain well records from previous drilling activity in a specific area so that a drill bit program may be prepared based on that past experience. Drilling times are estimated and the types of bits to be utilized to perform the drilling are selected. The number and types of drill bits may vary from one drill site to another. For extremely deep wells, hundreds of drill bits may be required to drill to the target depth.

Modern roller drill bits are generally of the three cone type. The bit cones include a number of teeth for drilling through a formation. For extremely hard formations, tungsten carbide insert bits or diamond bits may be employed.

Typically, the drill bits for a drilling program are supplied by a bit supplier. The bits are delivered to the drill site and stored so that they are readily available to be used as needed during the drilling operation. The drill bits are very expensive and an integral part of the drilling program and, therefore, great care must be taken to insure that the drill bits are not damaged during shipment or storage at the drill site.

Presently, drill bits are commonly shipped in reinforced wooden boxes. To withstand the rough treatment encountered in the field, the boxes are heavily reinforced to provide a sturdy container. The drill bits are placed in the wooden containers and anchored with packing or some type of bracing to prevent movement within the wooden container. The reinforced wooden container and drill bit contained therein are very heavy and thus difficult to move from one place to another. The shipping container of the present invention overcomes the disadvantages of the prior art drill bit shipping containers.

It is an object of the present invention to provide an extremely durable shipping container which is simple to use in the field.

It is another object of the present invention to provide a universal shipping container wherein a single container may be adapted to receive and secure drill bits having a range of diameters and lengths.

It is yet another object of the invention to provide a shipping container which is portable, compact and easily stackable, yet more durable than drill bit containers presently available in the prior art.

SUMMARY OF THE INVENTION

The present invention is directed to a universal shipping container. The container includes two telescoping components which cooperate to securely hold a drill bit in the shipping container. The outer component includes an opening through its upper end permitting the shank of the drill bit to extend therethrough. The two components include an adjustable locking mechanism for securely locking the components relative to each other. A removable ring member may be mounted to the upper end of the outer member for reducing the opening extending therethrough and enabling the container of the invention to accommodate different size drill bits.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not be considered limiting of its scope, for the invention may admit to other equally effective embodiments.

DETAILED DESCRIPTION OF THE PREFERRED EMBODIMENT

Figure 1:
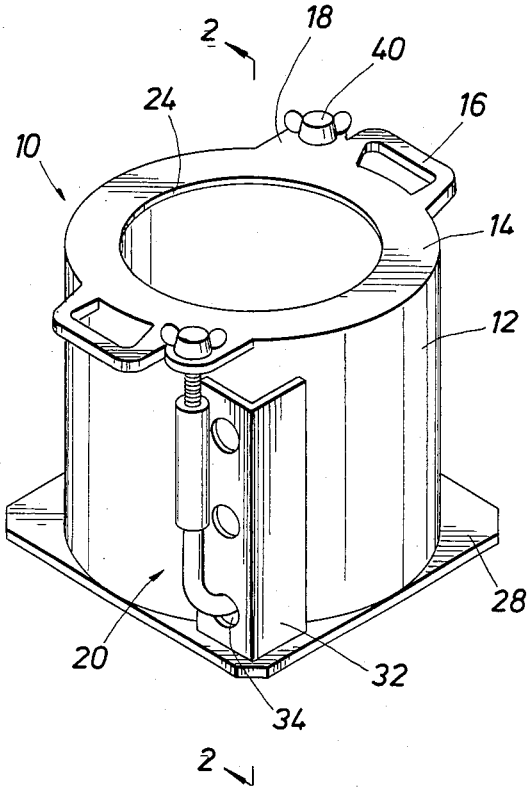
FIG. 1 is a perspective view of an embodiment of the invention.

Referring first to FIG. 1 of the drawings, the container of the invention is generally identified by the reference numeral 10. The container 10 includes two separable components. The outer component comprises a tubular body 12 open at one end and partially closed at the opposite end by a top ring plate 14. The ring plate 14 includes a pair of handles 16 integrally formed therewith for grasping and conveniently lifting the outer component to separate the two components of the container 10. The ring plate 14 includes a tab 18 adjacent each of the handles 16. The tabs 18 project outwardly and lie in the plane defined by the ring plate 14. The tabs 18 extend outwardly beyond the outer circumference of the body 12. Each of the tabs 18 includes a hole extending therethrough permitting the threaded end of a take up bolt device 20 to extend through the hole.

The ring plate 14 is welded or otherwise connected to the upper end of the body 12 as shown in FIG. 1. The ring plate 14 partially closes the upper end of the body 12. The center portion of the ring plate 14 is open permitting the threaded end or shank of a drill bit to extend therethrough as shown in phantom in FIG. 2. The central opening 22 in the ring plate 14 is defined by a circumferential edge 24.

Figure 3:
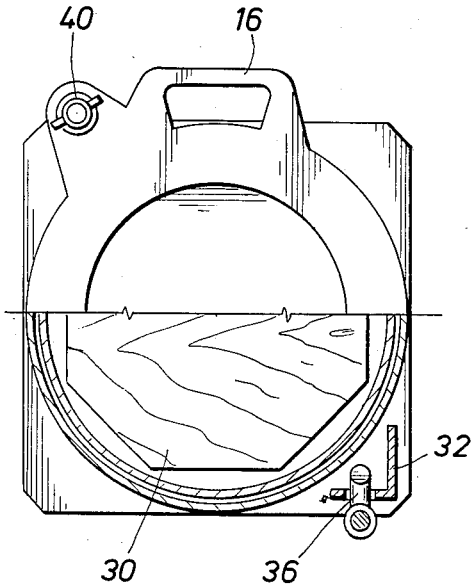
FIG. 3 is a top, partially broken away, plan view of the container of the invention.
Figure 2:
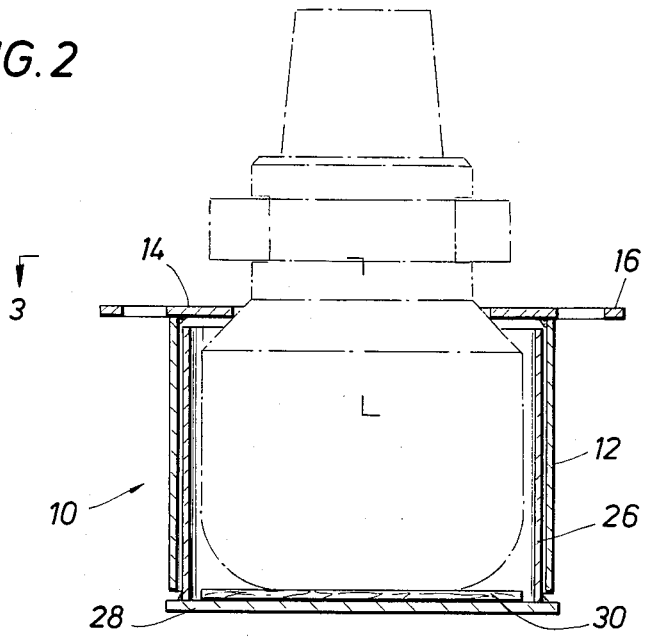
FIG. 2 is a sectional view of the container of the invention taken along line 2—2 of FIG. 1.

Referring now to FIGS. 2 and 3, the inner component of the container 10 includes an upstanding tubular body 26. The body 26 is closed at the lower end thereof by a base plate 28 which is welded or otherwise connected to the lower circumferential edge of the body 26. The upper end of the body 26 is open permitting a drill bit to be placed within the body 26 as shown in phantom in FIG. 2. The bottom plate 28 is substantially square in shape and extends outwardly beyond the outer circumference of the body 26 providing additional stability. Each corner of the bottom plate 28 is broken or cut at an angle so that no sharp corners remain, as shown in FIG. 1. Elimination of sharp corners eliminates the incidences of gouging or other types of damage which may be encountered during shipment and storage of the container 10. In the event a container 10 is dropped or turned on its side, the substantially square shape of the base plate 28 insures that the container 10 will not roll, and thereby substantially reducing the jolting action and possible damage to the drill bit contained within the container 10.

Most drill bits are of the three cone type having a plurality of teeth extending therefrom for drilling the well. During shipment, the drill bit teeth may be damaged if the drill bit is not securely anchored within the container 10. To substantially reduce the risk of damaging the drill bit teeth, a removable insert 30 is positioned on the bottom 28 of the inner member of the container 10. The drill bit rests on the insert 30 and the drill bit teeth dig into and grab the insert 30 so that sideward movement of the drill bit is prevented. The insert 30 is press fit in the body 26. The weight of the bit on the insert 30 also tends to substantially eliminate any movement of the insert 30 within the container 10. The insert 30 may be a piece of wood cut to the appropriate shape, for example, ply wood. The insert 30, however, is not limited to ply wood as it may be of any resilient or cushioning-type material having the capability of cushioning the drill bit and preventing the drill bit teeth from impacting the bottom 28 of the container 10.

Referring again to FIG. 2, it will be observed that the container 10 of the present invention receives the drill bit within a cavity defined by the tubular body 26 of the inner component of the container 10. The tubular body 12 of the outer component of the container 10 slides over the body 26. The threaded shank of the drill bit extends through the opening 22 in the ring plate 14. In FIG. 2, the body 12 of the outer member is depicted as substantially enclosing the body 26 of the inner member. In the event the drill bit has a longer body, the outer component may only partially telescope or slide over the inner component. The body 12 of the outer component is limited in its downward movement over the inner component upon engagement of the edge 24 of the ring plate 14 with the beveled or tapered back surface of the drill bit as shown in FIG. 2.

Figure 7:
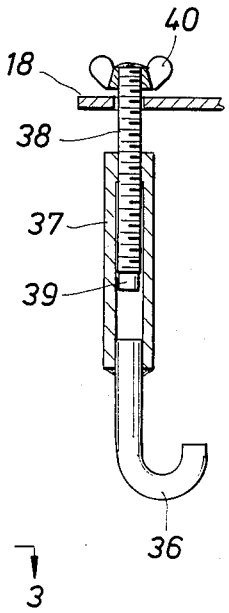
FIG. 7 is a sectional view of the take up bolt of the invention.

Referring now to FIGS. 1 and 7, the take up latch for locking the components of the container 10 together is shown in greater detail. The latch includes an upstanding angle bracket 32 welded to the bottom plate 28. Two angle brackets 32 are provided. The angle brackets 32 are welded adjacent opposite corners of the base plate 28. One side forming the angle brackets 32 includes a plurality of spaced apertures 34 for receiving the hook end 36 of the take up bolt 20 therethrough.

As best shown in FIG. 7, the take up bolt 20 comprises a hook end 36, a take up tube 37, a threaded shaft 38, and a heavy-duty wing nut 40. The upper end of the take up tube 37 is provided with intended threads for threadably engaging the shaft 38. The elements of the take up bolt 20 are welded together to form a single component permanently mounted to the outer component body 12.

The take up bolt 20 is assembled by initially threading the shaft 38 through the tube 37. The lower end of the shaft 38 is not threaded at 39. Once the shaft 38 and the tube 37 are threaded together as shown in FIG. 7, the shaft 38 and tube 37 cannot be separated. The blank on the shaft 38 at 39 acts as a stop to prevent separation of the shaft 38 from the tube 37. The hook 36 is then welded to the lower end of the take up tube 37. The upper end of the shaft 38 is advanced through the hole in the tabs 18 and the wing nut 40 is welded to the upper end of the shaft 38. Once assembled in this manner, the take up bolt is permanently mounted to the ring plate 14 and cannot be lost or misplaced.

Referring now to FIG. 3, it will be observed that the angle brackets 32 and the body 26 of the inner component define a gap therebetween permitting the body 12 of the outer component to slide down between the body 26 of the inner component and the angle brackets 32. As previously mentioned, the body 12 slides down over the body 26 until the tapered back surface of the drill bit is engaged by the edge 24 of the ring plate 14. At this point, the take up bolt 20 is adjusted to extend through one of the apertures 34 in the angle brackets 32. The wing nuts 40 are turned to advance the shaft 38 into the tube 37, thereby forcing the outer component downward to force the drill bit to dig into the insert 30.

Figure 4:
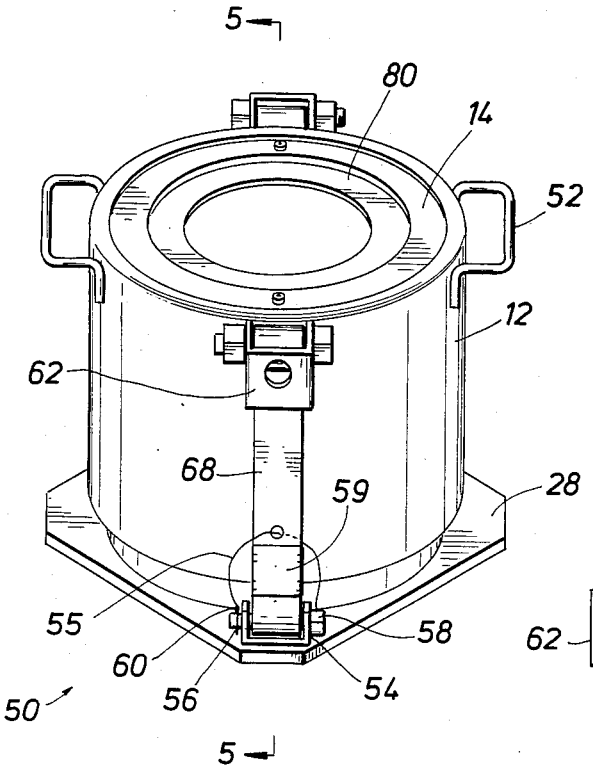
FIG. 4 is a perspective view of an alternate embodiment of the invention.
Figure 6:
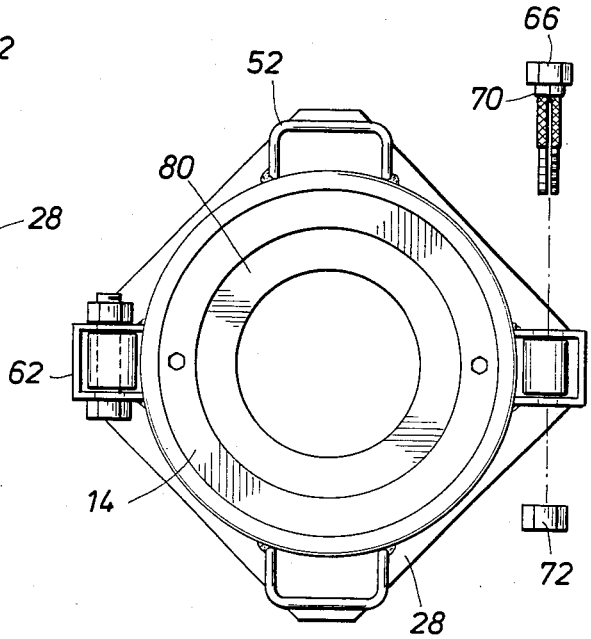
FIG. 6 is a top plan view of the invention showing the slotted bolt utilized in the locking mechanism of the invention.
Figure 5:
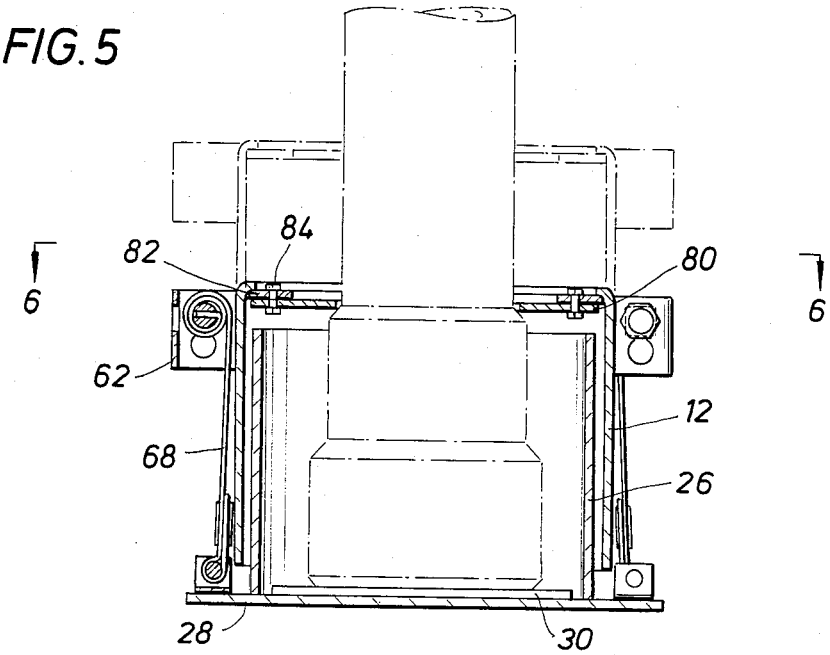
FIG. 5 is a sectional view of the container of the invention taken along line 5—5 of FIG. 4.

In FIGS. 4–6, an alternate embodiment of the invention is disclosed. The embodiment of the invention described heretofore in FIGS. 1–3 is substantially the same as the embodiment shown in FIGS. 4–6. Therefore, like reference numerals are employed in the description of the embodiment shown in FIGS. 4–6 to identify similar components.

Referring now to FIG. 4, the alternate embodiment of the invention is generally identified by the reference numeral 50. The container 50 includes an outer and inner component defined by the tubular bodies 12 and 26, respectively. A pair of handles 52 are mounted to the body 12 of the outer component. The handles 52 may be welded or otherwise mounted to the body 12 and extend outwardly therefrom substantially perpendicular to the body 12. The handles 52 are positioned so that they may be easily engaged by a forklift (not shown in the drawing) or other like device for lifting the container 50. The area on the body 12 below the handles 52 is free of any obstructions so that the forks of forklift may slide under the handles 52 and thereby lift the container 50 for loading and unloading for shipment or movement about the well site.

Tie down or fastening of the outer component to the inner component is accomplished by a flat strap fastener arrangement. A pair of U-shaped brackets 54 are welded adjacent opposite corners of the base 28 as shown in FIGS. 4 and 5. The brackets 54 includes a pair of legs 56 which extend upwardly to define a space therebetween. The legs 56 include aligned holes for receiving a clevis pin 58 therethrough. One end of the clevis pin 58 includes an enlarged head so that it cannot pass through the aligned holes in the legs 56. The opposite end of the clevis pin 58 includes a drilled hole therethrough for receiving a hair pin cotter 60 to lock the clevis pin 58 to the brackets 54. A flexible line or wire 55 connects the pin 60 to the clevis pin 58 so that the pin 60 is not separated from the clevis pin 58.

A pair of brackets 62 are mounted to the body 12 of the outer component so that when the two components are properly positioned, the brackets 62 are in substantial alignment with the brackets 54. The brackets 62 are U-shaped, having the legs 64 thereof welded to the body 12. The legs 64 include aligned square holes for receiving a split bolt 66 therethrough.

The shaft of the bolt 66 is split so that the end of the flat strap or band 68 extends through the slit and is folded over so that the strap 68 may be wound about the bolt 66 as shown in FIG. 5. The lower end of the strap 66 is folded over and fastened to itself so that a loop is formed to receive the clevis pin 58 therethrough. The loop is maintained by a band seal 59 which is crimped on the strap 68. The two components of the container 50 are fastened together by tightening the bolt 66 so that the strap 68 is wound thereabout. The bolt 66 is locked in position by forcing the square head thereof into one of the legs 64 of the bracket 62. The holes in the legs 64 are square-shaped to receive the square-shaped portion 70 of the split bolt 66. A nut 72 is threaded on the threaded end of the split bolt 66 thereby preventing the bolt 66 from slipping out of the square hole. A cotter pin 74 extending through the end of the split bolt 66 prevents the nut 72 from being completely unthreaded from the split bolt 66.

Drill bits are available in different sizes and lengths. To enable the use of the container 50 for shipment of various drill bits, a removable clamp ring 80 is provided. The clamp ring 80 may be bolted to the ring plate 14 as best shown in FIG. 5. The clamp ring 80 is a substantially flat circular ring profiled to fit within the body 12 of the outer component. A plurality of holes are formed in the ring plate 14 for alignment with corresponding holes formed in the ring clamp 80. Bolts 82 and nuts 84 are employed to mount the clamp ring 80 to the ring plate 14.

The center portion of the clamp ring 80 includes a circular opening which is substantially smaller than the opening 22 defined by the ring plate 14. The clamp ring 80 permits the container 15 to securely hold a drill bit which is much smaller than the drill bit shown in FIG. 2 and thus enables the container of the invention to be used as a shipping container for a wide range of drill bit sizes.

The shipping container of the present disclosure provides an extremely durable container for use in the oil well drilling industry. The components of the containers 10 and 50 may be fabricated of any material having durability sufficient to withstand the abuse encountered in the transportation of drill bits to the well site which may be located in extremely remote locations. Since the shank of the drill bit extends out of the container of the invention, the breaker wrench when required with each drill bit can easily be attached and shipped with the drill bit, as shown in phantom in FIG. 2.

The invention of the present disclosure is particularly suitable for shipping drill bits of various sizes. It is understood, however, that the shipping container of this invention is equally suitable as a shipping container for other tools or apparatus. The adjustable locking arrangement of the invention permits the shipping container to accommodate items of various shapes and sizes.

While the foregoing is directed to the preferred embodiments of the present invention, other and further embodiments of the invention may be devised without departing from the basic scope thereof, and the scope thereof is determined by the claims which follow.

What is claimed is:

1. A shipping container, comprising:

(a) an inner component defining a first tubular body closed at one end by a base plate;

(b) an outer component defining a second tubular body adapted for receiving said first tubular body of said inner component therein, said second tubular body being open at one end and partially closed at the other end by a ring plate mounted on said other end of said second tubular body;

(c) said ring plate extending inwardly to partially close said other end of said second tubular body and terminating at a central opening circumscribed by said ring plate;

(d) take up bolt means mounted on said ring plate for locking said inner component within said outer component; and (e) angle bracket means mounted on said base plate, said angle bracket means including at least one aperture extending through one side of said angle bracket means for engagement by said take up bolt means for effecting locking engagement of said inner component and said outer component.

2. The apparatus of claim 1 wherein said base plate is substantially flat and square-shaped having no sharp corners.

3. The apparatus of claim 1 wherein said outer component includes handle means projecting outwardly from said second tubular body providing a gripping surface for lifting the shipping container.

4. The apparatus of claim 1 including a removable ring clamp mounted to said ring plate for reducing the size of said central opening.

5. The apparatus of claim 1 wherein said take up bolt means comprises a downwardly extending hook connected to a take up tube, said take up tube defining a cavity closed by said hook at the lower end thereof, the upper end of said take up tube being internally threaded for threadably engaging a threaded shaft extending into said take up tube, said threaded shaft including a wing nut mounted to an end thereof extending out of said take up tube.

6. The apparatus of claim 5 wherein said ring plate includes handle means extending outwardly therefrom and tab means extending outwardly from said ring plate adjacent to said handle means, said tab means including a hole for receiving said threaded shaft of said take up bolt means therethrough.

7. The apparatus of claim 5 wherein said threaded shaft includes a blank about the end of said threaded shaft extending into said take up tube, said blank preventing separation of said threaded shaft from said take up tube.

8. The apparatus of claim 1 wherein said outer component includes handle means projecting outwardly from said second tubular body providing a gripping surface for lifting the shipping container.

9. A shipping container, comprising:

(a) an inner component defining a first tubular body closed at one end by a base plate;

(b) an outer component defining a second tubular body adapted for receiving said first tubular body of said inner component therein, said second tubular body being open at one end and partially closed at the other end by a ring plate mounted on said other end of said second tubular body;

(c) said ring plate extending inwardly to partially close said other end of said second tubular body and terminating at a central opening circumscribed by said ring plate; and (d) locking means for effecting locking engagement of said inner component and said outer component, said locking means comprising first bracket means mounted to said base plate and second bracket means mounted to said second tubular body, said first and second bracket means being connected by a strap extending from said first bracket means to said second bracket means.

10. The apparatus of claim 9 wherein said strap includes a lower looped end for receiving pin means therethrough for connecting said lower end to said first bracket means.

11. The apparatus of claim 10 including a split bolt extending through said second bracket means for receiving the upper end of said strap, said upper end of said strap being wound about said split bolt for securely fastening said inner component to said outer component.

12. The apparatus of claim 9 including a removable ring clamp mounted to said ring plate for reducing the size of said central opening.

* * * * *